US006223965B1

(12) United States Patent
Nakatsuka

(10) Patent No.: US 6,223,965 B1
(45) Date of Patent: May 1, 2001

(54) FINISHING APPARATUS PROVIDED WITH STAPLING FUNCTION

(75) Inventor: Kazuhiko Nakatsuka, Toyokawa (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/392,656

(22) Filed: Sep. 9, 1999

(30) Foreign Application Priority Data

Sep. 11, 1998 (JP) ..... 10-258300

(51) Int. Cl.[7] ..... B27F 7/19

(52) U.S. Cl. ..... 227/111; 227/131; 227/155; 270/58.08

(58) Field of Search ..... 227/111, 110, 227/131, 121, 155; 270/58.08; 399/410

(56) References Cited

U.S. PATENT DOCUMENTS 5,029,831 * 7/1991 Green ..... 227/111
5,100,119 * 3/1992 Komada et al. ..... 270/58.08
5,181,643 * 1/1993 Radtke ..... 227/110
5,279,494 * 1/1994 Kitajima et al. ..... 270/58.08
5,290,020 * 3/1994 Matsui et al. ..... 227/111
5,584,471 * 12/1996 Muck et al. ..... 227/131
5,772,197 * 6/1998 Aoki et al. ..... 270/58.08
5,806,750 * 9/1998 Yamanushi et al. ..... 227/131
6,050,471 * 4/2000 Yagi ..... 227/131

* cited by examiner

*Primary Examiner*—Scott A. Smith
(74) *Attorney, Agent, or Firm*—McDermott, Will & Emery

(57) ABSTRACT

In a stapler device wherein a head section 51 for driving a staple into a sheet stack and an anvil section 61 for receiving and bending the staple driven from the head section 51 are independent from each other and movable in a sheet-width direction of the sheet to be passed therebetween, the head section 51 and the anvil section 61 respectively include holders 52, 62, which are respectively guided by support shafts 81, 82 and drive shafts 72, 73, and a staple-driving unit 56 and a staple-receiving unit 65, which are detachable from their respective holders 52, 62.

22 Claims, 5 Drawing Sheets

FINISHING APPARATUS PROVIDED WITH STAPLING FUNCTION

This invention is based on applications No.10-258300 filed in Japan, the entire content of which is hereby incorporated by reference.

BACKGROUND OF THE INVENTION

1. Field of the Invention

The present invention relates generally to a stapler device and more particularly, to a stapler device for stapling sheets outputted from copiers or printers.

2. Description of the Related Art

A variety of finishers have generally been provided which operate to sort image-copied sheets outputted from the copier or printer into a desired number of sheet sets or perform a stapling operation. Of the prior-art stapler devices, the conventional type has an arrangement wherein a head section for driving a staple and an anvil section for receiving and bending the staple are fixed to a given position, thus binding a stack of sheets only at one place. More recently, however, with automation and diversification of the sheet finishing operation, the performance of the stapling operation is also diversified. Thus, a demand exists for an ability to selectively bind a stack of sheets at any one or more than one of binding positions such as a leading edge, a trailing edge and a center of the sheet stack.

For binding sheets at plural positions, a stapler unit (the head section and anvil section) must be moved in a sheet-width direction. A coupling member generally unifies the head section and the anvil section so as to ensure the alignment thereof. Because of the existence of the coupling member, however, the sheet stack can be transported into or out of a stapling section only after the coupling member is retreated. This results in an increased processing time, which lowers the productivity of copies.

Besides, a long coupling member is required for driving the staple into the center of the sheet stack. This results in low accuracy of positioning and an increased size of the stapler device.

In this connection, the present inventors have proposed in Japanese Unexamined Patent Publication No.9-255220 a stapler device wherein the head section and the anvil section are independent from each other thereby to dispense with the coupling member. In this device, the head section and the anvil section are guided by a support shaft, respectively. Unfortunately, at the occurrence of trouble such as caused by staple clogging in the head section or the anvil section, the head section or the anvil section along with the support shaft must be removed from the sorter for maintenance work which is quite cumbersome.

OBJECTS AND SUMMARY

It is therefore, an object of the invention to provide an improved stapler device which solves the aforementioned problems associated with the prior-art stapler devices.

It is a particular object of the invention to provide a stapler device featuring easy maintenance work for elimination of the staple clogging or the like despite that the head section and the anvil section are independent from each other.

For achieving the foregoing and other objects of the invention, the stapler device according to the invention comprises a head section and an anvil section which are independent from each other, and a head-section support shaft and an anvil-section support shaft for moving these sections in a sheet-width direction, wherein the head section includes a staple-driving holder guided by the head-section support shaft and a staple-driving unit detachable from the holder and wherein the anvil section includes a staple-receiving holder guided by the anvil-section support shaft and a staple-receiving unit detachable from the holder.

According to the invention, since the head section and anvil section are independent from each other and movable in a sheet-width direction, it is possible to staple plural places of the sheet stack and also to drive the staple into the center of the sheet stack (so called doublespread binding for weekly magazines). Furthermore, the head section is designed to permit the staple-driving unit to be detached from the staple-driving holder guided by the head-section support shaft or the anvil section is designed to permit the staple-receiving unit to be detached from the holder guided by the anvil-section support shaft. Hence, at the occurrence of trouble such as staple clogging or the like, only the staple-driving unit or/and the staple-receiving unit may be removed for carrying out required operation or maintenance work. Such an operation is quite simple because it does not require the whole body of the head section or anvil section together with the support shaft to be removed from the frame.

BRIEF DESCRIPTION OF THE DRAWINGS

These and other objects and features of the present invention will become apparent from the following description of a preferred embodiment thereof taken in conjunction with the accompanying drawings, in which.

In the following description, like parts are designated by like reference numbers throughout the several drawings.

DETAILED DESCRIPTION OF THE PREFERRED EMBODIMENT

A stapler device according to an embodiment of the invention will hereinbelow be described with reference to the accompanying drawings.

Figure 1:
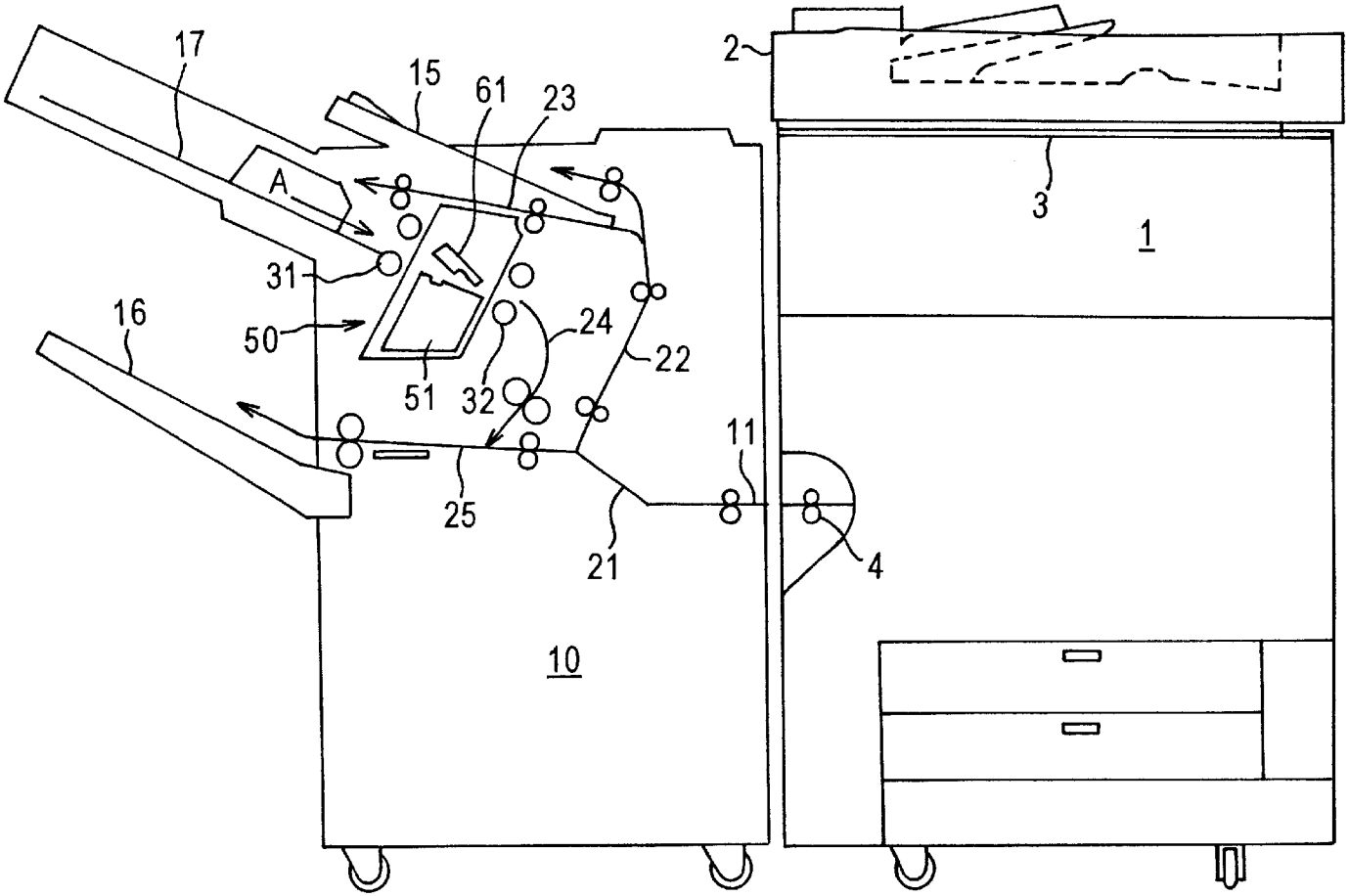
FIG. 1 is a schematic diagram showing an arrangement of a finisher with a stapler device of the invention and a copier.

FIG. 1 schematically illustrates an arrangement of an electrophotographic copier 1 and a finisher 10 provided with a stapler device 50 according to the invention. The copier 1 digitally reproduces an image of an original document. An ADF (Auto Document Feeder) 2 picks up documents on a one-by-one basis to feed it onto a platen glass 3 so that an image reader may read the image of the original document. The image data thus read is converted into print data and edited so as to be committed to a laser-beam scanning unit which, in turn, forms an electrostatic latent image on a photoconductor. After development, this electrostatic latent image is transferred to a copy sheet, which is discharged out of the copier by means of a pair of exit rollers 4.

The finisher 10 receives the image-copied sheet outputted from the copier 1 at its sheet input section 11 and performs processings such as folding, punching, binding and the like. A stapler device 50 for binding sheets is discussed further below but the description of the folding and punching operations is dispensed with.

The finisher 10 is provided with three trays 15, 16 and 17. The non-sort tray 15 is an upper bin for receiving sheets transported via sheet paths 21 and 22. The bulk tray 16 is a lower bin for receiving sheets transported via the sheet path 21 and a sheet path 25. The bulk tray 16 is adapted for receipt of a large volume of sheets by lowering step by step as the volume of sheets to receive increases.

The stapling process tray 17 is an intermediate bin for receiving sheets transported via the sheet paths 21, 22 and a sheet path 23. When a predetermined number of sheets are placed on the tray 17, a given number of sheets are fed from this sheet stack to the stapler device 50 by means of a pair of rollers 31 for the stapling operation. The sheet stack thus stapled is transported through a sheet path 24 and the sheet path 25 to be received by the bulk tray 16.

Next, the stapler device 50 is discussed.

Figure 2:
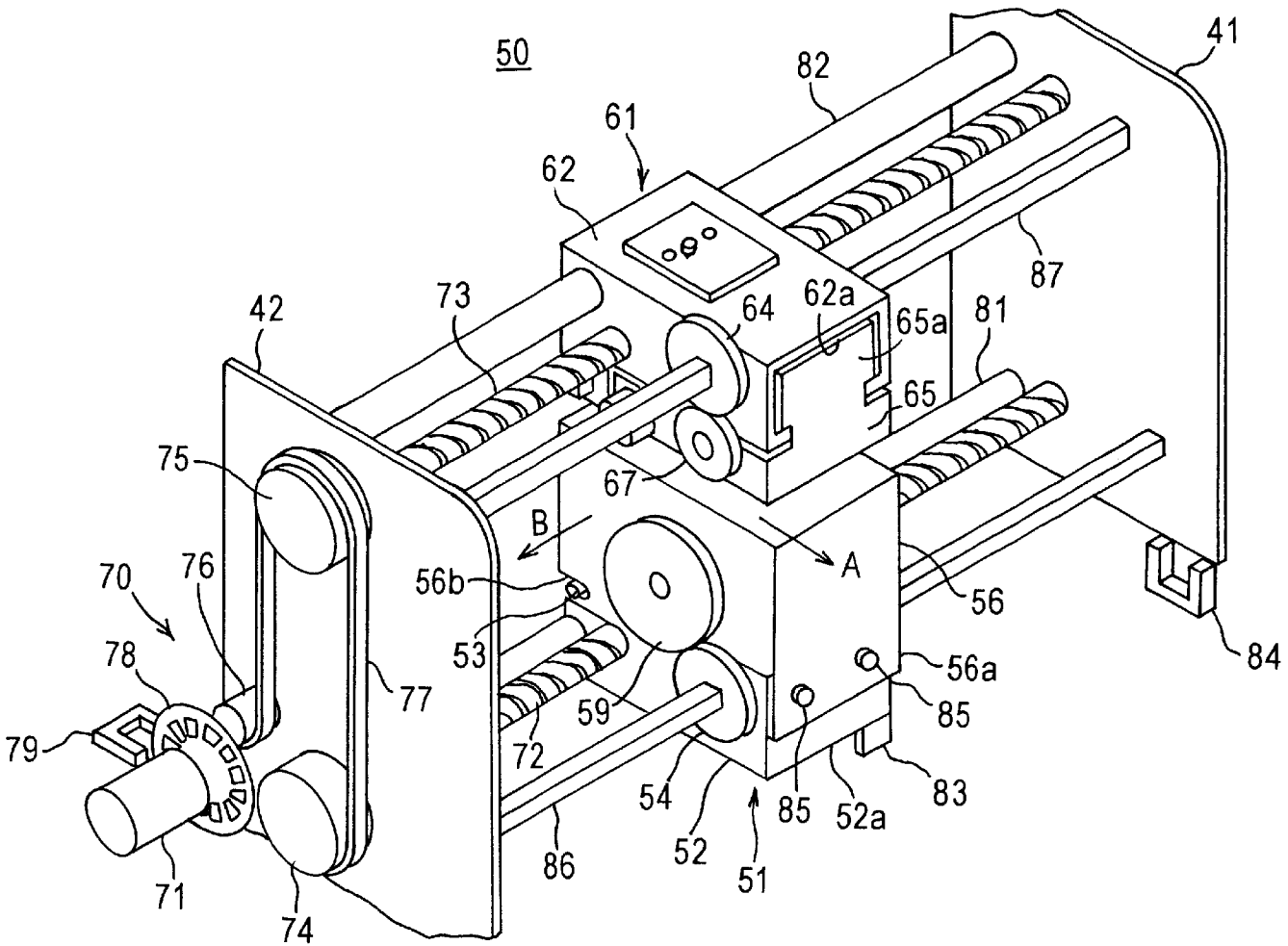
FIG. 2 is a perspective view showing a stapler device according to one embodiment of the invention.

As shown in FIG. 2, the stapler device 50 includes a head section 51 for driving a staple, an anvil section 61 operating to receive and bend both ends of the staple driven through a sheet stack, a drive mechanism 70 for separately moving the head section 51 and the anvil section 61 in a sheet-width direction B, which is perpendicular to a stack transportation direction A, and support shafts 81, 82 for guiding and carrying the head section 51 and the anvil section 61 in the sheet-width direction B, respectively.

As shown in FIG. 1, the stapler device 50 is provided with respective pairs of rollers 31, 32 on an input side and output side thereof. Of the roller pairs 31, 32, a respective upper roller is adapted to come into or go out of contact with its corresponding lower roller. The roller pairs operate to transport the sheet stack in the direction A as holding the stack therebetween and to bring the stack to a temporary halt at a given stapling position.

The support shafts 81, 82 are fixed to frames 41, 42 which define a gap therebetween such as to permit the passage of a sheet of maximum size to be stapled.

The drive mechanism 70 is arranged such that a timing belt 77 is stretched on an unillustrated output pulley of a servo-motor 71 which is mounted to the frame 42, pulleys 74, 75 fixed to respective ends of drive shafts 72, 73 and a tension pulley 76. The servo-motor 71 is adapted for normal and reverse rotation which accordingly drives the drive shafts 72, 73 into normal and reverse rotation. The drive shafts 72, 73 are each formed with a spiral groove on its surface. The head section 51 and the anvil section 61 incorporates members (not shown) engaging the spiral grooves, respectively, for movement in the direction of Arrow B or in the reverse direction in accordance with the normal or reverse rotation of the drive shafts 72, 73. The amount of movement is controlled based on the number of revolution of the servo-motor 71, the number of revolution being sensed by a sensor 79 in terms of the number of revolution of a rotor plate 78.

A home position for the head section 51 and the anvil section 61 is defined to be a position adjoining the frame 41. Whether the head section 51 and the anvil section 61 are in the home position or not is determined by a sensor 84 detecting a projection 83 provided at the head section 51.

Figure 3:
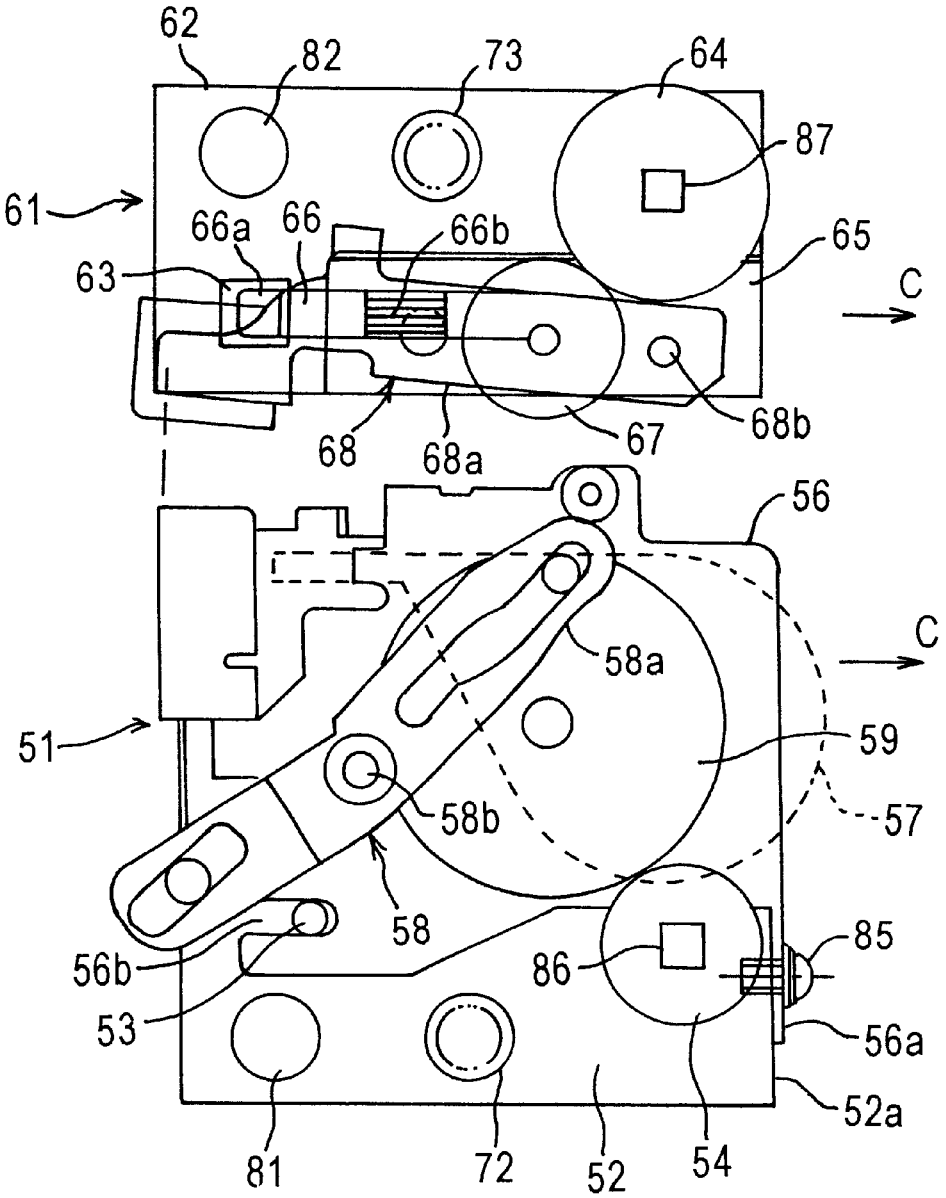
FIG. 3 is a front view showing a holder and a unit in unified state.
Figure 4:
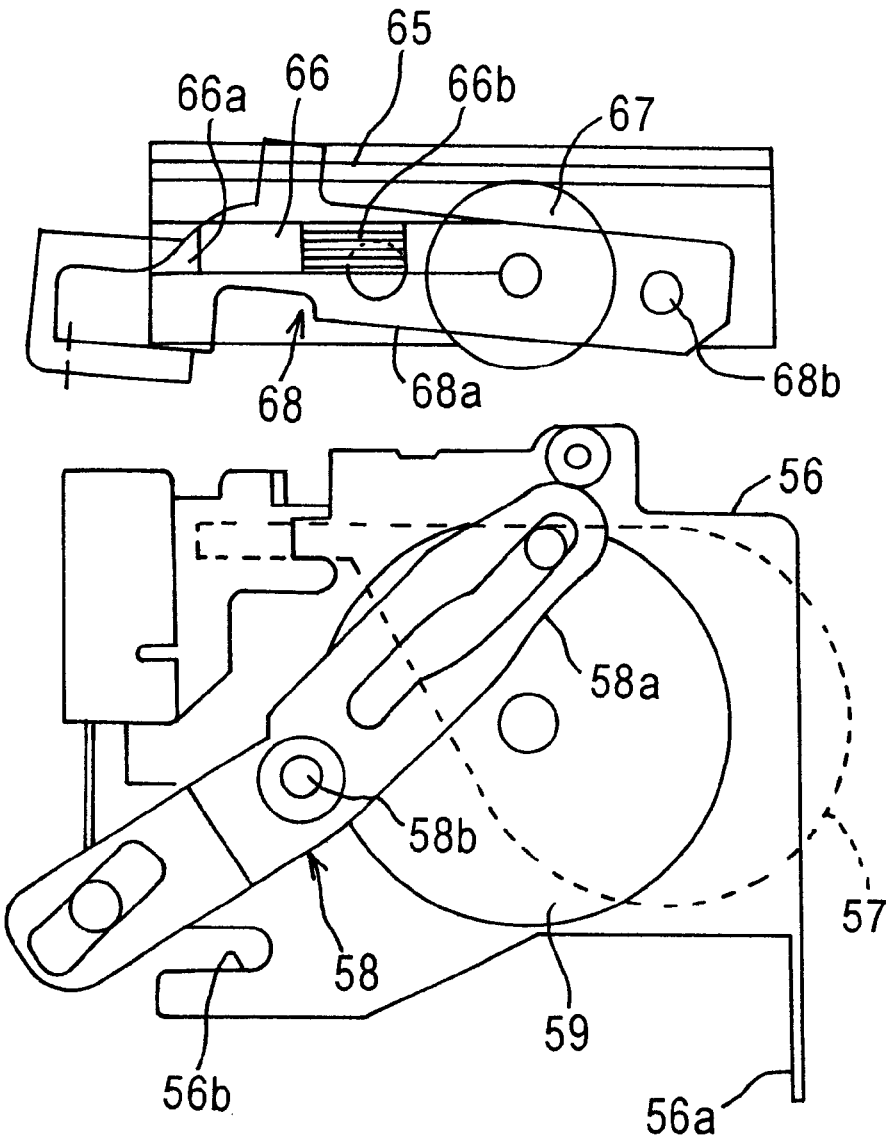
FIG. 4 is a front view showing the holder and the unit in detached state.
Figure 5:
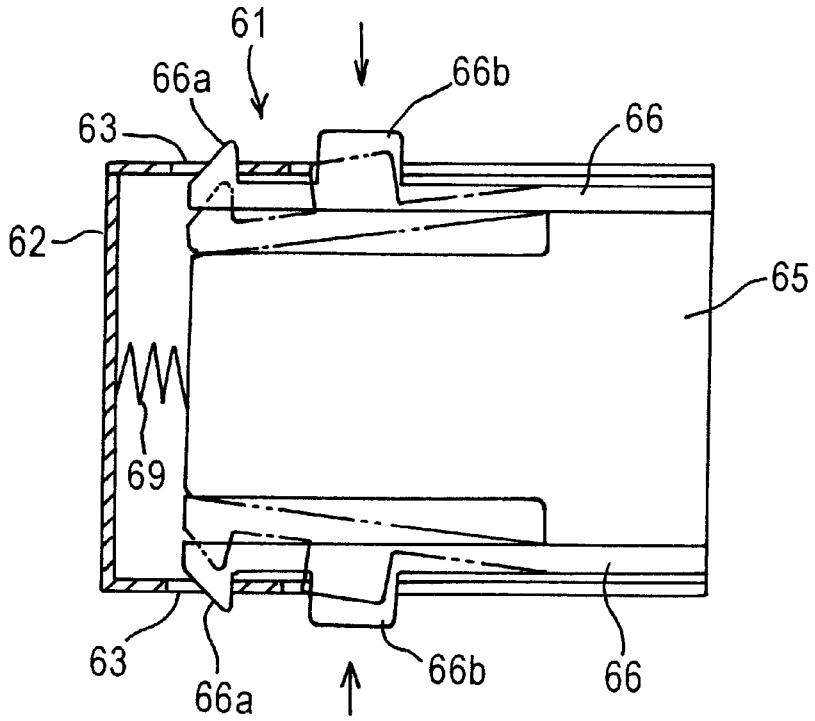
FIG. 5 is a plane view showing an anvil section of the stapler device.

Now referring to FIGS. 3, 4 and 5, constructions of the head section 51 and the anvil section 61 are described.

The head section 51 is roughly divided into a staple-driving holder 52 guided by the support shaft 81 and engaging the spiral groove of the drive shaft 72, and a staple-driving unit 56. The staple-driving unit 56 includes a staple cartridge 57 containing staples therein and a mechanism 58 for driving a staple into a sheet stack, the staple fed from the staple cartridge 57. As shown in FIGS. 3 and 4, the staple-driving unit 56 can be detached from the staple-driving holder 52 in a direction of Arrow C. The staple-driving unit 56 is attached on the staple-driving holder 52, as vertically aligned therewith, through engagement between grooves **56*b* formed in both sides of the staple-driving unit 56 and pins 53 projecting from the staple-driving holder 52. A projection 56*a* of the staple-driving unit 56 is abutted against an end face 52*a* of the holder 52 while a screw 85 is tightened against the projection 56*a*. Thus, the staple-driving unit 56 is attached with the staple-driving holder 52**.

A drive force for the staple-driving mechanism 58 is transmitted through gear-connection between a gear 54 of the staple-driving holder 52 and a gear 59 of the staple-driving unit 56. An operation of the staple-driving mechanism 58 is effected in a manner that a drive shaft 86 of a square sectional form rotates to bring, via the gears 54 and 59, a lever **58*a* of the staple-driving mechanism 58 into rotation around a pin 58*b* as a fulcrum. The drive shaft 86 is caused to rotate by an unillustrated drive source disposed externally of the frame 41 (or 42). The staple-driving unit 56 is readily detached from the staple-driving holder 52 by loosing the screw 85**.

On the other hand, the anvil section 61 is roughly divided into a staple-receiving holder 62 which is guided by the support shaft 82 and engages the spiral groove of the drive shaft 73, and a staple-receiving unit 65 which includes a mechanism 68 for receiving and bending both ends of a staple driven through the sheet stack. As shown in FIG. 2, the staple-receiving unit 65 has a construction wherein a convex section **65*a* thereof engages a concave section 62*a* of the staple-receiving holder 62. As shown in FIG. 4, the unit can be detached from the staple-receiving holder 62** in the direction of Arrow C.

As shown in FIG. 5, the staple-receiving unit 65 is provided with a resilient lock lever 66 on both sides thereof, respectively. A claw **66*a* of the lever engages a square hole 63 formed in the staple-receiving holder 62 thereby unifying the staple-receiving unit 65 with the staple-receiving holder 62. At this time, a coil spring 69 is compressed as pressed against an inside wall of the holder 62 thereby preventing free play of the staple-receiving unit 65. A projection 66*b* formed at the lock lever 66 extends outside of the holder 62. Pushing this projection 66*b* brings the claw 66*a* out of engagement with the square hole 63 so that a momentum of the coil spring 69 acts to detach the staple-receiving unit 65 from the staple-receiving holder 62**.

A drive force for the staple-receiving mechanism 68 is transmitted through gear-connection between a gear 64 disposed at the holder 62 and a gear 67 disposed at the unit 65. An operation of the staple-receiving mechanism 68 is effected in a manner that a drive shaft 87 of a square sectional form is rotated in synchronism with the stapling operation thereby bringing, via the gears 64 and 67, a lever **68*a* of the staple-receiving mechanism 68 into rotation around a pin 68*b* as a fulcrum. The drive shaft 87 is caused to rotate by an unillustrated drive source disposed externally of the frame 41 (or 42**).

As described in the foregoing, the embodiment hereof is arranged such that the staple-driving unit 56 including the staple-driving mechanism 58 can be detached from the staple-driving holder 52 and that the staple-receiving unit 65 including the staple receiving mechanism 68 can be detached from the staple-receiving holder 62. Consequently, at the occurrence of trouble such as staple clogging or the like in the staple-driving mechanism 58 or the staple-receiving mechanism 68, the staple-driving unit 56 and/or the staple-receiving unit 65 can singly be detached from the stapler device 50 for maintenance work. Specifically, there is no need to remove the support shafts 81, 82. and the drive shafts 72, 73, resulting in quite simple maintenance work. Furthermore, there exists no member interfering with the transportation of a sheet stack so that staples can be driven into plural places of the stack regardless of that the stapling position is at the leading edge portion, the trailing edge portion or the center of the stack.

It is noted that the arrangement for dividing the device into the head section and the anvil section or the construction of sheet stack transportation means may arbitrarily be made. Additionally, a single servo-motor for movement may be shared by the head section and the anvil section. Otherwise, the head section and the anvil section may individually be provided with the servo-motors. Alternatively, the utilization of a linear motor is possible.

In the embodiment hereof, both the staple-driving unit and the staple-receiving unit are detachable from the respective holders but only one of these may be detachable.

Although the present invention has been fully described by way of an example with reference to the accompanying drawings, it is to be noted that various changes and modifications will be apparent to those skilled in the art. Therefore, unless such changes and modification depart from the scope of the present invention, they should be construed as being included therein.

What is claimed is:

1. A finisher for stapling a set of sheets transported to a stapling position in the finisher, comprising:

a staple head which drives a staple into the set of sheets at the stapling position, the staple being driven by the staple head in a stapling direction, a staple anvil which receives and bends the staple driven from the staple head;

a first support shaft which supports the staple head movable, the staple head being movable alone the first support shaft; and a second support shaft which supports the staple anvil movable, the staple anvil being movable alone the second support shaft, wherein the staple head includes a head holder connected with the first support shaft and a staple-driving unit which includes a mechanism for driving the staples into the set of sheets, and the stapling unit is detachable from the head holder in a direction different from the stapling direction and perpendicular to the first support shaft.

2. The finisher as claimed in claim 1, wherein the staple-driving unit has a cartridge which contains and feeds the staples.

3. The finisher as claimed in claim 1, wherein the staple anvil includes an anvil holder connected with the second support shaft and a staple-receiving unit detachable from the anvil holder.

4. The finisher as claimed in claim 1, further comprising;

a drive mechanism which moves the staple head and the staple anvil together in the same direction.

5. The finisher as claimed in claim 1, wherein the stapling direction is perpendicular to a transporting direction of the set of sheets.

6. The finisher as claimed in claim 5, wherein the transporting direction of the set of sheets is parallel with the stapling unit detachable direction.

7. A finisher for stapling a set of sheets transported to a stapling position in the finisher, comprising:

a staple head which drives a staple into the set of sheets at the stapling position, the staple being driven by the staple head in a stapling direction;

a staple anvil which receives and bends the staple driven from the staple head;

a first support shaft which supports the staple head movable, the staple head being movable along the first support shaft; and a second support shaft which supports the staple anvil movable, the staple anvil being movable along the second support shaft, wherein the staple anvil includes an anvil holder connected with the second support shaft and a staple-receiving unit which includes a mechanism for receiving and bending the staple driven from the staple head, and the staple-receiving unit is detachable from the anvil holder in a direction different from the stapling direction and perpendicular to the second support shaft.

8. The finisher as claimed in claim 7, wherein the staple head includes a head holder connected with the first support shaft and a staple-driving unit detachable from the head holder.

9. The finisher as claimed in claim 7, further comprising;

a drive mechanism which moves the staple head and the staple anvil together in the same direction.

10. The finisher as claimed in claim 7, wherein the stapling direction is perpendicular to a transporting direction of the set of sheets.

11. The finisher as claimed in claim 10, wherein the transporting direction of the set of sheets is parallel with the staple-receiving unit detachable direction.

12. A finisher for stapling a set of sheets transported to a stapling position in the finisher, comprising:

a staple head which drives a staple into the set of sheets at the stapling position, the staple being driven by the staple head in a stapling direction;

a staple anvil which receives and bends the staple driven from the staple head; and support means which support the staple head and the staple anvil movable, the staple head and the staple anvil being movable along the support means, wherein the staple head includes a head holder connected with the support means and a staple-driving unit which includes a mechanism for driving the staple into the set of sheets, and the stapling unit is detachable from the head holder in a direction different from the stapling direction and perpendicular to the support means.

13. The finisher as claimed in claim 12, wherein the staple-driving unit has a cartridge which contains and feeds the staples.

14. The finisher as claimed in claim 12, wherein the staple anvil includes an anvil holder connected with the support means and a staple-receiving unit detachable from the anvil holder.

15. The finisher as claimed in claim 12, further comprising;

a drive mechanism which moves the staple head and the staple anvil together in the same direction.

16. The finisher as claimed in claim 12, wherein the stapling direction is perpendicular to a transporting direction of the set of sheets.

17. The finisher as claimed in claim 16, wherein the transporting direction of the set of sheets is parallel with the stapling unit detachable direction.

18. A finisher for stapling a set of sheets transported to a stapling position in the finisher, comprising:

a staple head which drives a staple into the set of sheets at the stapling position, the staple being driven by the staple head in a stapling direction;

a staple anvil which receives and bends the staple driven from the staple head; and support means which support the staple head and the staple anvil movable, the staple head and the staple anvil being movable along the support means, wherein the staple anvil includes an anvil holder connected with the support means and a staple-receiving unit which includes a mechanism for receiving and bending the staple driven from the staple head, and the staple-receiving unit is detachable from the anvil holder in a direction different from the stapling direction and perpendicular to the support means.

19. The finisher as claimed in claim 18, wherein the staple head includes a head holder connected with the support means and a staple-driving unit detachable from the a head holder.

20. The finisher as claimed in claim 18, further comprising;

a drive mechanism which moves the staple head and the staple anvil together in the same direction.

21. The finisher as claimed in claim 18, wherein the stapling direction is perpendicular to a transporting direction of the set of sheets.

22. The finisher as claimed in claim 21, wherein the transporting direction of the set of sheets is parallel with the staple-receiving unit detachable direction.

* * * * *